United States Patent [19]

Lanfermann et al.

[11] 4,155,600

[45] May 22, 1979

[54] SUPPORT FOR MOVABLE SEGMENTS IN A RACK FOR A DRUM CUTTER MINING MACHINE

[75] Inventors: Willy Lanfermann; Dieter Lauterbach, both of Bochum, Fed. Rep. of Germany

[73] Assignee: Gebr. Eickhoff Maschinenfabrik und Eisengiesserei m.b.H., Bochum, Fed. Rep. of Germany

[21] Appl. No.: 901,956

[22] Filed: May 1, 1978

[30] Foreign Application Priority Data

May 14, 1977 [DE] Fed. Rep. of Germany ..... 2721867

[51] Int. Cl.[2] ..... E21C 29/02

[52] U.S. Cl. ..... 299/43

[58] Field of Search ..... 299/32, 33, 34, 42, 299/43–48

[56] References Cited

U.S. PATENT DOCUMENTS 4,082,361 4/1978 Laneermann ..... 299/43

FOREIGN PATENT DOCUMENTS 2629255 1/1978 Fed. Rep. of Germany ..... 299/43

*Primary Examiner*—Ernest R. Purser

*Attorney, Agent, or Firm*—Thomas H. Murray; Clifford A. Poff

[57] ABSTRACT

A rack device consisting of movable and immovable rack segments extends along a face conveyor for a mining machine having a drive gear engageable with the rack device to propel the machine along the working face of a mine. Rack holders are fixedly connected to conveyor pan sections joined together for pivotal movement to form the face conveyor. The rack segments are coupled to spaced-apart rack holders by pivot shafts. The immovable rack segments extend along a single conveyor pan section while each movable rack segment bridges a joint between conveyor pan sections. Pivot shafts for the movable rack segments are received in elongated slots in the rack holders whereby the movable rack segments move through a gap distance formed by a clearance between the pivot shaft and the slot. This gap distance is greater in magnitude than the clearance between the joined conveyor pan sections.

4 Claims, 5 Drawing Figures

SUPPORT FOR MOVABLE SEGMENTS IN A RACK FOR A DRUM CUTTER MINING MACHINE

BACKGROUND OF THE INVENTION

This invention relates to a rack device for a getting machine, particularly a drum cutter mining machine for underground mining operations wherein the rack device includes longitudinally movable rack segments arranged to bridge the joints between the conveyor pan sections of a face conveyor with the ends of the longitudinally movable rack segments being supported together with adjoining ends of immovable rack segments by rack holders which are fixedly connected to the face conveyor and coupled to the individual rack segments by means of connecting bolts extending transversely to the longitudinal orientation of the rack segments.

It has been proposed in the past to connect rack segments to each other in a hinged manner for bridging the joints between conveyor pan sections. Joint pins used to connect the rack segments together were also connected to the face conveyor or to the side bracket wall so that the rack segments underwent limited longitudinal movement. According to the construction of parts, the joint pins used to establish the hinged connection between the rack segments have projecting ends extending into horizontal slots in duct walls which enclose the sides of the rack. The object and purpose of this construction of parts are, by the use of suitable dimensioning of the slots, to provide pan sections of the face conveyor with adequate means to permit angular positioning of the pan sections with respect to the rack.

Another proposal in the past was addressed to providing a rack having longitudinal portions, bridging the joints between pan sections, which are pivotally connected to each other at the ends of the adjacent rack segments by means of common holders mounted on the face conveyor. The ends of the longitudinal rack segments project beyond each rack drive pin by a distance corresponding to one-half of the rack pin pitch. The projected ends of the rack segments have at least one curved end face about the axis of the last rack pin about a radius corresponding to one-half of the rack pin pitch. Slots in the holders which accommodate the ends of the mounting bolts extend in a direction corresponding to the longitudinal orientation of the rack. Each slot is so dimensioned and arranged, with respect to the end of the bolt that engages therein, so as to permit the end faces of adjacent rack segments to bear upon each other.

SUMMARY OF THE INVENTION

It is an object of the present invention to provide a construction and arrangement of parts for a rack device consisting of rack segments and connecting elements joining the segments together without the development of stresses caused by the shifting motion of the face conveyor or which result from a bent configuration of the conveyor pan sections when adapted to characteristics of a mine floor or result from curvilinear conveyor characteristics and without restricting the movability of the rack segments provided by connecting elements with respect to the face conveyor.

More particularly, according to the present invention, there is provided in combination with a drum cutter mining machine, a rack device carried by a face conveyor which includes a plurality of conveyor pan sections joined together end-to-end forming a clearance between the joints while the face conveyor extends along the path of travel by the mining machine at the working face of an underground mine, the mining machine including drive gear means to drivingly engage the rack device which includes the combination of a plurality of elongated rack segments each having rack gear teeth at spaced intervals along the extended length therewith to mesh with the drive gear means, the plurality of elongated rack segments consisting of movable rack segments bridging the joints between the conveyor pan sections and immovable rack segments each extending along a single conveyor pan section, rack holders fixedly connected to the conveyor pan sections for supporting the elongated rack segments, and pivot shafts extending transversely to the extended length of each elongated rack segment to couple the elongated rack segments to the rack holders, each movable rack segment being coupled for longitudinal movement through gap distances formed with the pivot shafts for the movable rack segments, each gap distance being greater in magnitude than the clearance between adjoined conveyor pan sections bridged by the movable rack segment, the immovable rack segments being coupled by the pivot shafts to rack holders for immovable support thereby.

Thus, the present invention provides that all the rack holders are adapted to maintain movability for the movable rack segments which bridge the joints between adjacent conveyor pan sections. These rack segments are movable in the longitudinal orientation of the face conveyor and through the gap distances which are greater than the clearance between adjacent conveyor pan sections while extending in the longitudinal orientation of the face conveyor. The immovable rack segments are arranged to extend between the movable rack segments while supported by the conveyor pan sections. The individual conveyor pan sections therefore retain the essential movability defined by their pivotal connection with respect to each other to the fullest extent so that the conveyor pan sections adapt to each other independently of the rack device supported thereby. Since the connecting elements for the movable rack segments which bridge the joints between the conveyor pan sections can only be stressed when the face conveyor sections are set at a vertical or horizontal angle to each other or displaced relative to each other through a disstance greater than the connecting elements between the rack holders, stresses originating from the face conveyor are eliminated by the rack device of the present invention.

A further feature of the present invention resides in the arrangement that each of two holders which enclose the joint between adjoined conveyor pan sections have two bores for accommodating the connecting bolts. The bores in these holders which are nearest the joint are elongated into a slotted configuration extending in a direction along the longitudinal orientation of the conveyor. In this way, only the movable rack segments which bridge the joint between the conveyor pan sections are provided with a range of movement with respect to the holder and therefore also with respect to the conveyor pan section for shifting or setting of the pan sections at an angle. The immovable rack segments are situated between joints for the conveyor pan sections and therefore these immovable rack segments are fixed with respect to the conveyor pan section.

The direction and magnitude of the sliding travel by the connecting bolts or pivot shafts situated within the slotted bores of the holders are, therefore, dependent on whether the conveyor pan sections are installed through a dip in the mine floor or over a hump in the mine floor, since the mounting bolts which connect the individual rack segments to the holders are situated beneath the rack teeth. It is, therefore, provided that the two elongated holes in the holders for a movable rack segment are disposed asymmetrical to the hole centers for the immovable rack segments when the conveyor pan sections are situated in a normal position. The two elongated holes are extended to a greater extent in the directions which face away from the joint between the conveyor pan sections. The slot which restricts movability of the rack segments to the clearance is harmless in regard to tooth engagement between the rack and the drive gearwheels carried on the getting machine. The slot always assumes a position which substantially corresponds to the range of motion of the holder when the conveyor pan sections are set at an angle or when the face conveyor is shifted. This insures that the mere slight mutual movability of adjacent rack segments forming the rack precisely covers the range of motion of adjacent conveyor pan sections so that there is no position of the conveyor pan sections even in an extreme configuration, in which the holders receiving the connecting bolts are restricted in their movability or are even stressed by movements of the face conveyor.

These features and advantages of the present invention as well as others will be more fully understood when the following description is read in light of the accompanying drawings, in which.

Figure 1:
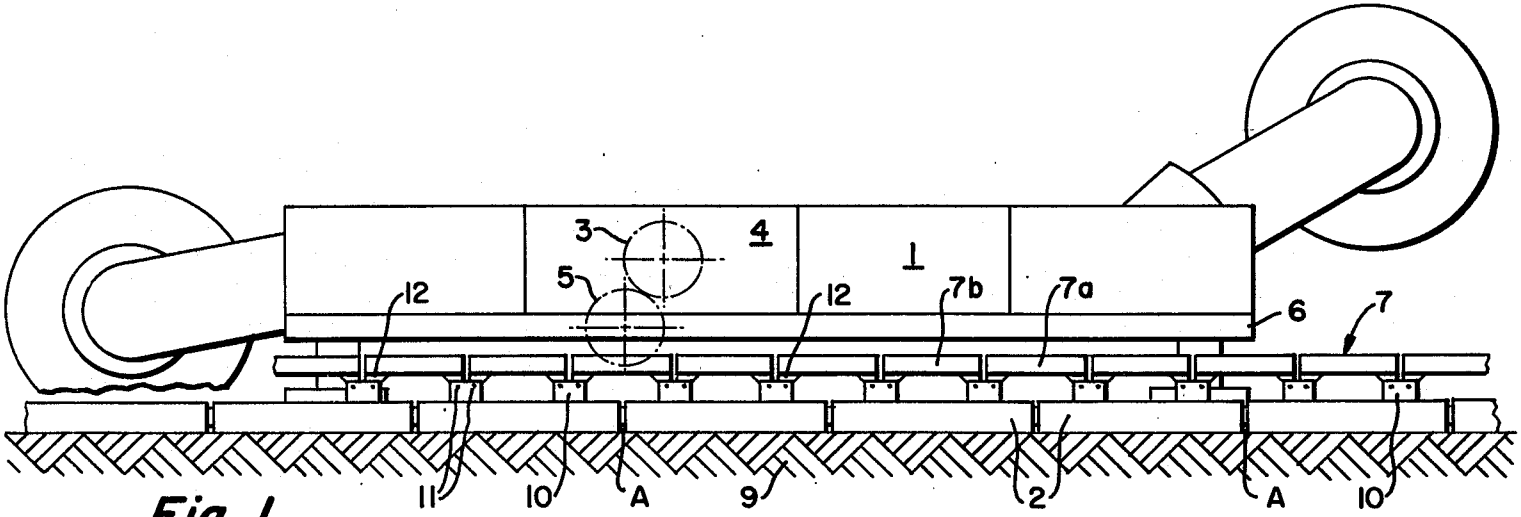
FIG. 1 is a front elevational view of a drum cutter mining machine propelled along a face conveyor through the use of a rack device according to the present invention.

In FIG. 1, reference numeral 1 denotes a drum cutter mining machine. The drum cutter mining machine is traversed along a face conveyor 2 by means of a driving wheel 3 secured to a winch 4. The driving wheel 3 meshes with a gearwheel 5 which is rotatably supported on the machine frame 6 forming part of the drum cutter mining machine. The teeth of the gearwheel 5 mesh with rack gear teeth of a rack device 7.

Figure 4:
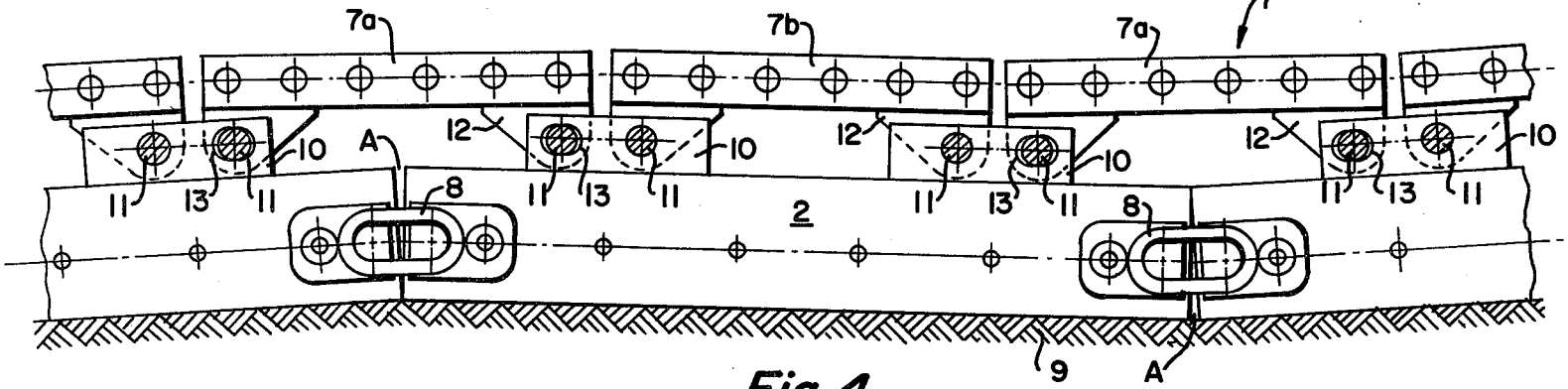
FIG. 4 is a view similar to FIGS. 2 and 3 but illustrating the rack carried by the face conveyor upon an undulating floor.

As illustrated in FIGS. 2–5, the face conveyor 2 is made up of a plurality of conveyor pan sections joined together end-to-end by connecting elements 8. By means of these connecting elements, the conveyor pan sections are maintained movable with respect to each other so that the conveyor pan sections are adaptable to characteristics of the mine floor. FIG. 4 illustrates an undulating mine floor and the angular relation between the conveyor pan sections while supported on the mine floor. To the end, the individual conveyor pan sections are connected together by the connecting elements 8 to provide not only limited movability with respect to each other in the horizontal direction of the conveyor 2 but also to provide vertical or horizontal angling of one conveyor pan section with respect to another when set on the mine floor. The rack device 7 which is mounted onto the face conveyor 2 undergoes the same horizontal motions as the conveyor pan sections. When the face conveyor is shifted, the rack device also undergoes the same vertical angular motions which the conveyor pan sections undergo particularly when it is desired to work undulating portions of a mine seam. The rack device includes a plurality of elongated rack segments consisting of movable rack segments 7*a* and immovable rack segments 7*b*. The rack segments are all supported by holders 10 that are directly or indirectly connected to the face conveyor 2. Connecting bolts 11 are used to join the individual rack segments to the holders 10.

The movable and immovable rack segments 7*a* and 7*b*, respectively, of the rack device 7 are provided at both ends of each segment with a nose-shaped extension 12 which projects downwardly. This extension includes a bore for accommodating a connecting bolt 11 forming a pivot shaft. As shown in FIG. 1, the movable rack segments 7*a* bridge a joint A between the conveyor pan sections. The movable rack segments 7*a* are mounted onto the same two holders 10 which are used to mount one end of adjacent immovable rack segments 7*b*. These immovable rack segments are each entirely disposed to extend along a single conveyor pan section. Thus, according to the preferred construction of the present invention, two rack holders 10 are secured at spaced-apart locations to a conveyor pan section. Each immovable rack segment 7*b* is secured by connecting bolts 11 at its opposite ends to the two rack holders which additionally support the adjacent ends of movable rack segments. The movable rack segments 7*a* which bridge the joint between the conveyor pan sections are supported in the holders 10 for limited movability in a longitudinal direction of the rack segments in order to provide that the individual conveyor pan sections of the face conveyor 2 are not impeded for relative movement and angular setting. In this regard, the connection between the movable rack segments 7*a* and the holders provides a clearance which is greater than the connection clearance between individual conveyor pan sections. Each of the holders 10 is provided with a slot 13 located on one-half of the holders which is nearest the joint between the conveyor pan sections. The slots 13 in the holders 10 extend in a direction corresponding to the longitudinal orientation of the face conveyor. The connecting bolts 11 extend through the slots and provide the associated movable rack segment 7*a* with adequate movability with respect to the face conveyor. The rack connection is, therefore, maintained free of forces which occur during the course of shifting movement to the face conveyor or result from angular motions of the conveyor pan sections in the horizontal and vertical directions. The immovable rack segments 7*b* are fixed with respect to the face conveyor 2 by the connecting bolts 11 which retain these rack segments by extending through bores 13′ formed in the remaining half of the holders 10. Each bore 13′ corresponds to the diameter of the bolt 11.

Figure 2:
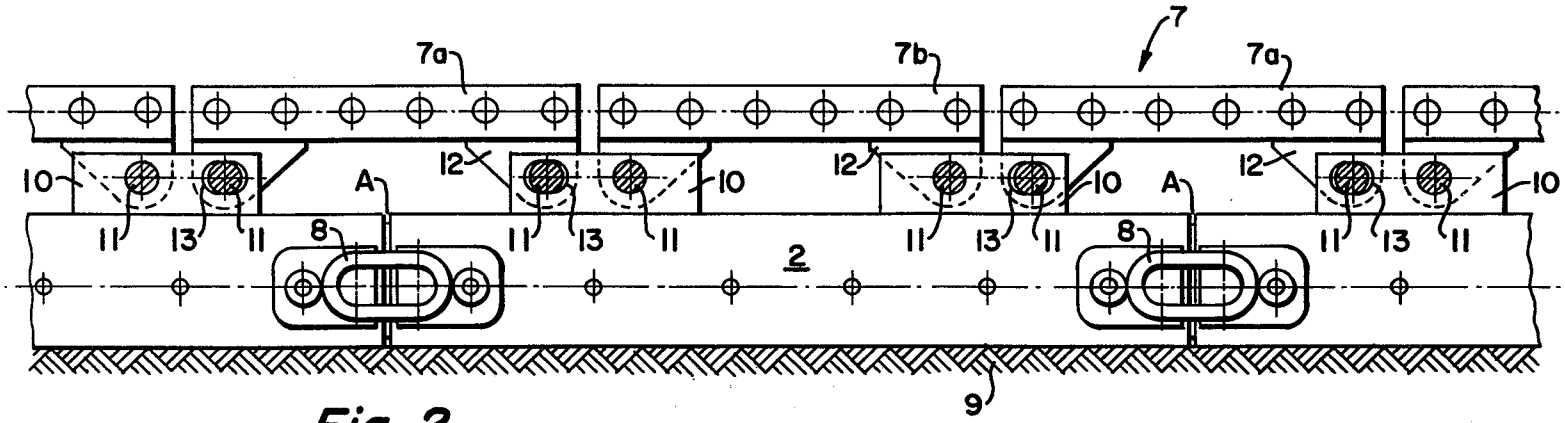
FIG. 2 is an enlarged view of the rack device shown in FIG. 1 while supported by a face conveyor in its normal position.
Figure 3:
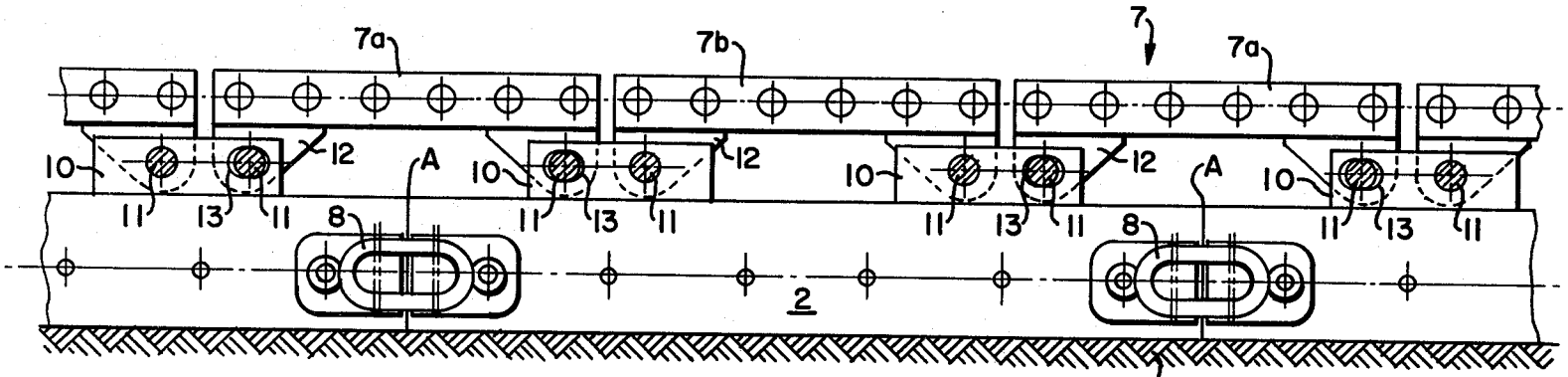
FIG. 3 is a view similar to FIG. 2 but illustrating angular positioning of the face conveyor and rack device.
Figure 5:
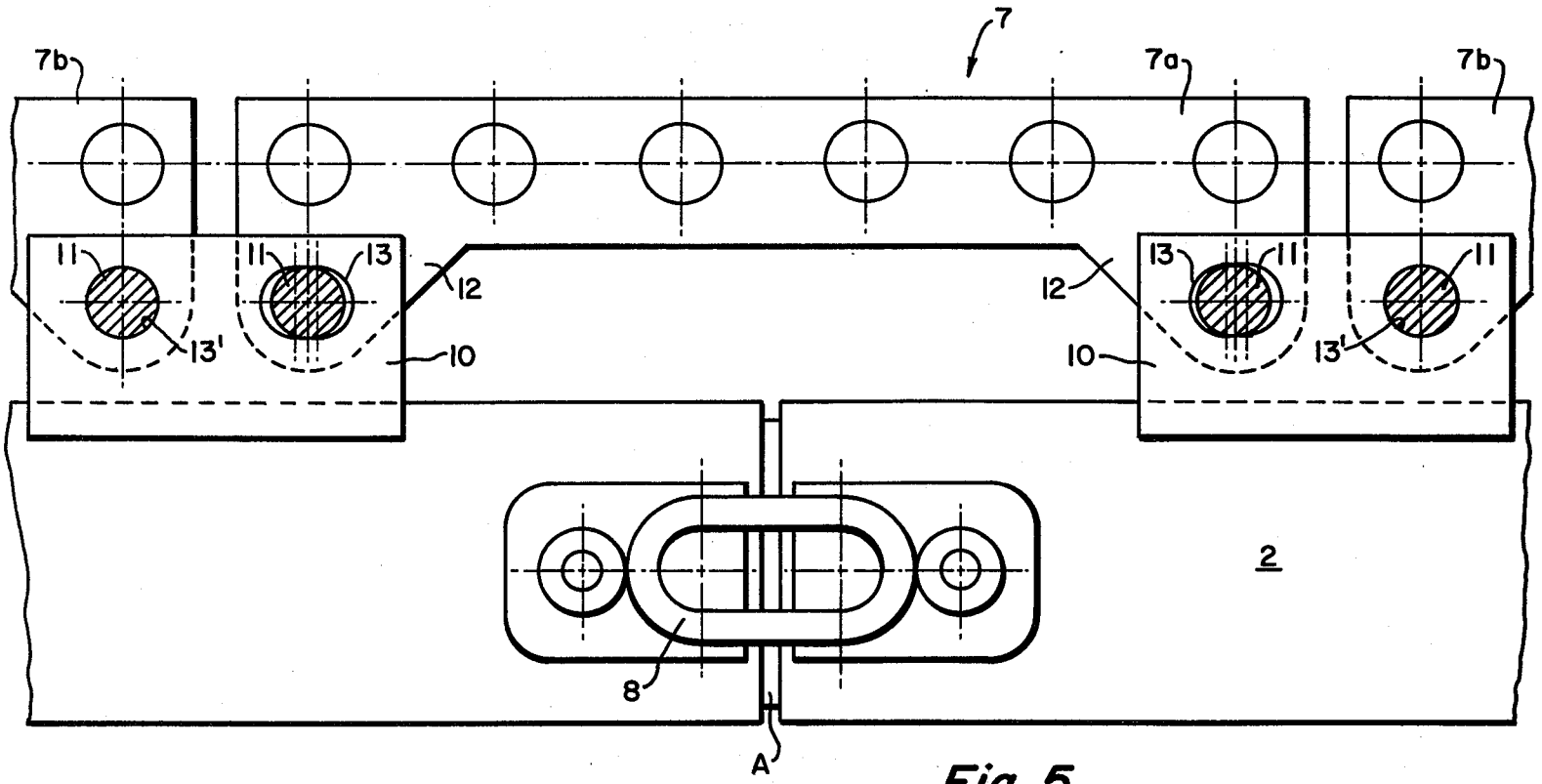
FIG. 5 is an enlarged view of the rack device and face conveyor shown in FIGS. 1–4.

As shown in FIG. 4, the movable rack segments 7*a* accommodate different relative motions with respect to the conveyor pan sections when set at an angle, depending upon the location of the center of curvature between the angularly-arranged conveyor pan sections. The sliding motion becomes greater as the radius of curvature between the conveyor pan sections becomes greater. If the center of the curvature is situated beneath the face conveyor 2, as shown in the left-hand part of FIG. 4, the sliding travel of the connecting bolts 11 with respect to the movable rack segments *7a* must be greater than in the right-hand part of the illustration shown in FIG. 4 where the center of curvature of the face conveyor is situated on the side of the rack 7, i.e., above the face conveyor 2. For this reason, and more particularly as shown in FIG. 5, the slot 13 in each holder 10 is enlarged to a greater extent in the direction which faces away from the joint between the conveyor pan sections in relation to the center of the bore in the nose-shaped extension 12. Thus, the slot 13 is situated asymmetrically with respect to the middle of the connecting bolt 11 retained by extension 12 when the bolt assumes its normal position which occurs when the conveyor pan sections are positioned in a normally-aligned relation as shown in FIG. 2.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. In combination with a drum cutter mining machine, a rack device carried by a face conveyor which includes a plurality of conveyor pan sections adjoined together end-to-end forming clearances between the joints while the face conveyor extends along the path of travel by the mining machine at the working face of an underground mine, said mining machine including drive gear means to drivingly engage the rack device which includes the combination of:

a plurality of elongated rack segments each having rack gear teeth at spaced intervals along the extended length thereto to mesh with said drive gear means, said plurality of elongated rack segments consisting of movable rack segments bridging said joints between the conveyor pan sections and immovable rack segments each extending along a single conveyor pan section, rack holders fixedly connected to said conveyor pan sections for supporting said elongated rack segments, and pivot shafts extending transversely to the extended lengths of each elongated rack segment to couple said elongated rack segments to said rack holders, each movable rack segment being coupled for longitudinal movement through gap distances formed with the pivot shafts for the movable rack segment, said gap distances being greater in magnitude than said clearance between adjoined conveyor pan sections bridged by the movable rack segment, said immovable rack segments being coupled by the pivot shafts to rack holders for immovable support thereby.

2. The combination according to claim 1 wherein the individual ones of said rack holders fixedly connected to said conveyor pan sections to support said movable rack segments each includes an elongated slot and a bore for accommodating said pivot shaft, the elongated slot being elongated along a direction parallel to the extended length of the face conveyor and lying nearest the joint between conveyor pan sections.

3. The combination according to claim 2 wherein said movable rack segments each has spaced-apart holes to receive pivot shafts for support by two of said rack holders, and wherein said elongated slot and bore in the rack holders adjacent the joint between conveyor pan sections are disposed asymmetrical to the distance between the spaced-apart holes in movable rack segments when the conveyor pan sections extend at normally-aligned positions.

4. The combination according to claim 3 wherein with the conveyor pan sections extending along normally-aligned positions, the elongated slot in said rack holders is expanded to extend to a greater extent in the direction away from the joint between conveyor pan sections.

* * * * *